US006096196A

United States Patent [19]

Varadaraj et al.

[11] Patent Number: 6,096,196

[45] Date of Patent: Aug. 1, 2000

[54] REMOVAL OF NAPHTHENIC ACIDS IN CRUDE OILS AND DISTILLATES

[75] Inventors: Ramesh Varadaraj, Flemington, N.J.; Thomas M. Pugel, Riegelsville, Pa.; David W. Savage, Lebanon, N.J.

[73] Assignee: Exxon Research and Engineering Co., Florham Park, N.J.

[21] Appl. No.: 09/049,465

[22] Filed: Mar. 27, 1998

[51] Int. Cl.[7] ..... C10G 19/00

[52] U.S. Cl. ..... 208/263; 208/290; 208/291

[58] Field of Search ..... 208/290, 291, 208/263

[56] References Cited

U.S. PATENT DOCUMENTS

| | | | |
|---|---|---|---|
| 2,168,078 | 8/1939 | Yabroff | 208/263 |
| 2,424,158 | 7/1947 | Fuqua et al. | 196/41 |
| 2,878,181 | 3/1959 | Ayers et al. | 208/263 |
| 3,066,094 | 11/1962 | Weikart et al. | 208/226 |
| 3,176,041 | 3/1965 | Ayers et al. | 208/263 |
| 3,186,934 | 6/1965 | Nielsen | 208/2 |
| 4,737,265 | 4/1988 | Merchant et al. | 208/188 |
| 4,752,381 | 6/1988 | Ferguson et al. | 208/263 |
| 4,789,460 | 12/1988 | Tabler et al. | 208/180 |
| 4,895,641 | 1/1990 | Briceno et al. | 208/286 |
| 5,961,821 | 10/1999 | Varadaraj et al. | 208/263 |

FOREIGN PATENT DOCUMENTS

| | | | |
|---|---|---|---|
| 0670361 | 9/1995 | European Pat. Off. | C10G 29/20 |

*Primary Examiner*—Walter D. Griffin
*Assistant Examiner*—Nadine Preisch
*Attorney, Agent, or Firm*—Estelle C. Bakun

[57] ABSTRACT

The instant invention is directed a process for extracting organic acids from a starting crude oil comprising the steps of: (a) treating the starting crude oil containing naphthenic acids with an amount of an alkoxylated amine and water under conditions and for a time and at a temperature sufficient to form a water-in-oil emulsion of amine salt wherein said alkoxylated amine is selected from the group consisting of alkoxylated amines having the following formulae (A) and (B):

(A)

where m+n=5 to 50 and R=linear or branched alkyl group of $C_8$ to $C_{20}$.

(B) $H\text{-}(OCH_2CH_2)_y\text{-}(CH_2CHCH_3O)_p\text{-}\{NHCH_2CH_2NH\}_x\text{-}(CH_2CH_2O)_z\text{-}(CH_2CHCH_3O)_q\text{-}H$ where x=1 to 3 and y+z=2 to 6, and wherein p+q=0 to 15, mixtures of formula (A) and mixtures of formula (B); wherein said starting crude oil is selected from the group consisting of crude oils, crude oil blends, and crude oil distillates; and (b) separating said emulsion of step (a) into a plurality of layers, wherein one of such layers contains a treated crude oil having decreased amounts of organic acids; (c) recovering said layer of step (b) containing said treated crude oil having a decreased amount of organic acid and layers containing water and alkoxylated amine salt.

35 Claims, 4 Drawing Sheets

REMOVAL OF NAPHTHENIC ACIDS IN CRUDE OILS AND DISTILLATES

FIELD OF THE INVENTION

The instant invention is directed to the removal of organic acids, specifically naphthenic acids in crude oils, crude oil blends and crude oil distillates using a specific class of compounds.

BACKGROUND OF THE INVENTION

High Total Acid Number (TAN) crudes are discounted by about $0.50/TAN/BBL. The downstream business driver to develop technologies for TAN reduction is the ability to refine low cost crudes. The upstream driver is to enhance the market value of high-TAN crudes.

The current approach to refine acidic crudes is to blend the acidic crudes with non acidic crudes so that the TAN of the blend is no higher than about 0.5. Most major oil companies use this approach. The drawback with this approach is that it limits the amount of acidic crude that can be processed. Additionally, it is known in the art to treat the crudes with inorganic bases such as potassium and sodium hydroxide to neutralize the acids. This approach, however, forms emulsions which are very difficult to break and, additionally, undesirably leaves potassium or sodium in the treated crude. Furthermore, such prior art techniques are limited by the molecular weight range of the acids they are capable of removing.

With the projected increase of acidic crudes in the market (Chad, Venezuela, North Sea) new technologies are needed to further refine higher TAN crudes and crude blends. Thermal treatment, slurry hydroprocessing and calcium neutralization are some of the promising approaches that have emerged. However, these technologies do not extract the acids from the crudes. Instead, they convert the acids to products that remain in the crude.

U.S. Pat. No. 4,752,381 is directed to a method for neutralizing the organic acidity in petroleum and petroleum fractions to produce a neutralization number of less than 1.0. The method involves treating the petroleum fraction with a monoethanolamine to form an amine salt followed by heating for a time and at a temperature sufficient to form an amide. Such amines will not afford the results desired in the instant invention since they convert the naphthenic acids, whereas the instant invention extracts and removes them.

U.S. Pat. No. 2,424,158 is directed to a method for removing organic acids from crude oils. The patent utilizes a contact agent which is an organic liquid. Suitable amines disclosed are mono-, di-, and triethanolamine, as well as methyl amine, ethylamine, n- and isopropyl amine, n-butyl amine, sec-butyl amine, ter-butyl amine, propanol amine, isopropanol amine, butanol amine, sec-butanol, sec-butanol amine, and ter-butanol amine. Such amines have been found to be ineffective in applicants' invention.

SUMMARY OF THE INVENTION

The instant invention is directed to a process for extracting organic acids from a starting crude oil comprising the steps of:

(a) treating the starting crude oil containing naphthenic acids with an amount of an alkoxylated amine and water under conditions and for a time and at a temperature sufficient to form a water-in-oil emulsion of amine salt wherein said alkoxylated amine is selected from the group consisting of alkoxylated amines having the following formulae (A) and (B):

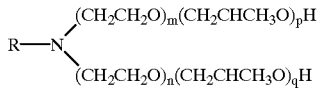

(A)

where m+n=5 to 50 and R=linear or branched alkyl group of $C_8$ to $C_{20}$.

(B) $H\text{-}(OCH_2CH_2)_y\text{-}(CH_2CHCH_3O)_p\text{-}\{NHCH_2CH_2NH\}_x\text{-}(CH_2CH_2O)_z\text{-}(CH_2CHCH_3O)_q\text{-}H$ where x=1 to 3 and y+z=2 to 6, and wherein p+q=0 to 15, mixtures of formula (A) and mixtures of formula (B); wherein said starting crude oil is selected from the group consisting of crude oils, crude oil blends, and crude oil distillates; and (b) separating said emulsion of step (a) into a plurality of layers, wherein one of such layers contains a treated crude oil having decreased amounts of organic acids;

(c) recovering said layer of step (b) containing said treated crude oil having a decreased amount of organic acid and layers containing water and alkoxylated amine salt.

The present invention may suitably comprise, consist or consist essentially of the elements disclosed herein and may be practiced in the absence of an element not disclosed.

DETAILED DESCRIPTION OF THE INVENTION

Figure 1:
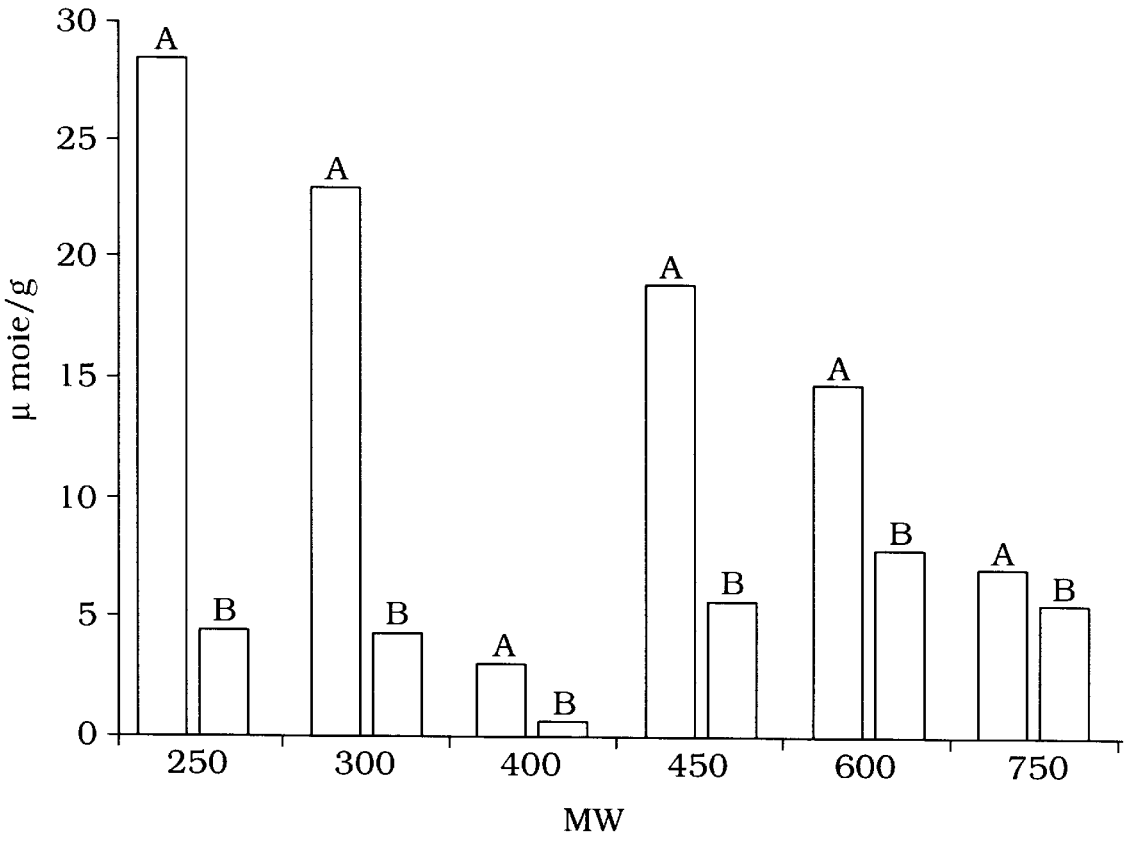
FIG. 1 is a bar chart depicting the TAN reduction of Gryphon crude using tertiary amine ethoxylates as the treating agent, over an organic acid molecular weight (MW) range of 250 to 750. The black bars are gryphon crude and the white bars are tertiary amine treated gryphon crude. The molecular weight of the organic acid is shown on the x axis and $\mu$ moles per gram on the y axis.

In the instant invention alkoxylated amines of the following formulae (A) and (B):

(A)

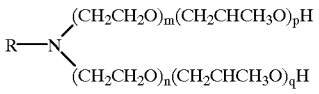

and (B) $H\text{-}(OCH_2CH_2)_y\text{-}(CH_2CHCH_3O)_p\text{-}\{NHCH_2CH_2NH\}_x\text{-}(CH_2CH_2O)_z\text{-}(CH_2CHCH_3O)_q\text{-}H$ are added to a starting crude oil to remove organic acids. Some crude oils contain organic acids that generally fall into the category of naphthenic acids and other organic acids. Naphthenic acid is a generic term used to identify a mixture of organic acids present in a petroleum stock. Naphthenic acids may be present either alone or in combination with other organic acids, such as sulfonic acids and phenols. Thus, the instant invention is particularly suitable for extracting naphthenic acids.

The important characteristics of the alkoxylated amines are that the amine is miscible in the oil to be treated, and that the alkoxy groups impart water solubility or dispersability to the salts formed. Suitable alkoxylated amines include dodecyl pentaethoxy amine. In the above formula m+n is 2 to 50, preferably 5 to 15 and m and n are whole numbers. R=linear or branched alkyl with $C_8$ to $C_{20}$, preferably $C_{10}$ to $C_{14}$. Suitable amines of formula (B) include N,N'-bis(2-hydroxyethyl) ethylene diamine. In the above formula, x=1 to 3, and y+z=2 to 6, and x, y and z are whole numbers; p+q=0 to 15, preferably 0 to 10. Preferably p+q=0. Mixtures of formula (A) and mixtures of formula (B) may be used. Additionally, mixtures of formula (A) with formula (B) may also be utilizable.

In the instant invention, organic acids, including naphthenic acids which are removed from the starting crude oil or blends are preferably those having molecular weights ranging from about 150 to about 800, more preferably, from about 200 to about 750. The instant invention preferably substantially extracts or substantially decreases the amount of naphthenic acids present in the starting crude. By substantially is meant all of the acids except for trace amounts. However, it is not necessary for substantially all of the acids to be removed since the value of the treated crude is increased if even a portion of the naphthenic acids are removed. Applicants have found that the amount of naphthenic acids can be reduced by at least about 70%, preferably at least about 90% and, more preferably, at least about 95%.

Starting crude oils (starting crudes) as used herein include crude blends and distillates. Preferably, the starting crude will be a whole crude, but can also be acidic fractions of a whole crude such as a vacuum gas oil. The starting crudes are treated with an amount of alkoxylated amine capable of forming an amine salt with the organic acids present in the starting crude. This typically will be the amount necessary to neutralize the desired amount of acids present. Typically, the amount of alkoxylated amine will range from about 0.15 to about 3 molar equivalents based upon the amount of organic acid present in the crude. If one chooses to neutralize substantially all of the naphthenic acids present, then a molar excess of alkoxylated amine will be used. Preferably, 2.5 times the amount of naphthenic acid present in the crude will be used. The molar excess allows for higher weight molecular acids to be removed. The instant invention is capable of removing naphthenic acids ranging in molecular weight from about 150 to about 800, preferably about 250 to about 750. The weight ranges for the naphthenic acids removed may vary upward or downward of the numbers herein presented, since the ranges are dependent upon the sensitivity level of the analytical means used to determine the molecular weights of the naphthenic acids removed.

The alkoxylated amines can be added alone or in combination with water. If added in combination, a solution of the alkoxylated amine and water may be prepared. Preferably, about 5 to 10 wt % water is added based upon the amount of crude oil. Whether the amine is added in combination with the water or prior to the water, the crude is treated for a time and at a temperature at which a water-in-oil emulsion of alkoxylated amine salts of organic acids will form. Contacting times depend upon the nature of the starting crude to be treated, its acid content, and the amount of alkoxylated amine added. The temperature of reaction is any temperature that will affect reaction of the alkoxylated amine and the naphthenic acids contained in the crude to be treated. Typically, the process is conducted at temperatures of about 20 to about 220° C., preferably, about 25 to about 130° C., more preferably, 25 to 80° C. The contact times will range from about 1 minute to 1 hour and, preferably, from about 3 to about 30 minutes. Pressures will range from atmospheric, preferably from about 60 psi and, more preferably, from about 60 to about 1000 psi. For heavier crudes, the higher temperatures and pressures are desirable. The crude containing the salts is then mixed with water, if stepwise addition is performed at a temperature and for a time sufficient to form an emulsion. The times and temperatures remain the same for simultaneous addition and stepwise addition of the water. If the addition is done simultaneously, the mixing is conducted simultaneously with the addition at the temperatures and for the times described above. It is not necessary for the simultaneous addition to mix for a period in addition to the period during which the salt formation is taking place. Thus, treatment of the starting crude includes both contacting and agitation to form an emulsion, for example, mixing. Heavier crudes, such as those with API indices of 20 or lower and viscosities greater than 200 cP at 25° C., preferably, will be treated at temperatures above 60° C.

Once the water in oil emulsion has been formed, it is separated into a plurality of layers. The separation can be achieved by means known to those skilled in the art. For example, centrifugation, gravity settling, and electrostatic separation. A plurality of layers results from the separation. Typically, three layers will be produced. The uppermost layer contains the crude oil from which the acids have been removed. The middle layer is an emulsion containing alkoxylated amine salts of high and medium weight acids, while the bottom layer is an aqueous layer containing alkoxylated amine salts of low molecular weight acids. The uppermost layer containing treated crude is easily recoverable by the skilled artisan. Thus, unlike the treatments used in the past whereby the acids are converted into products which remain in the crude, the instant process removes the acids from the crude. The layers containing the naphthenic acids may have potential value as specialty products.

Additionally, though not required, demulsification agents may be used to enhance the rate of demulsification and co-solvents, such as alcohols, may be used along with the water.

The process can be conducted utilizing existing desalter units.

Figure 2:
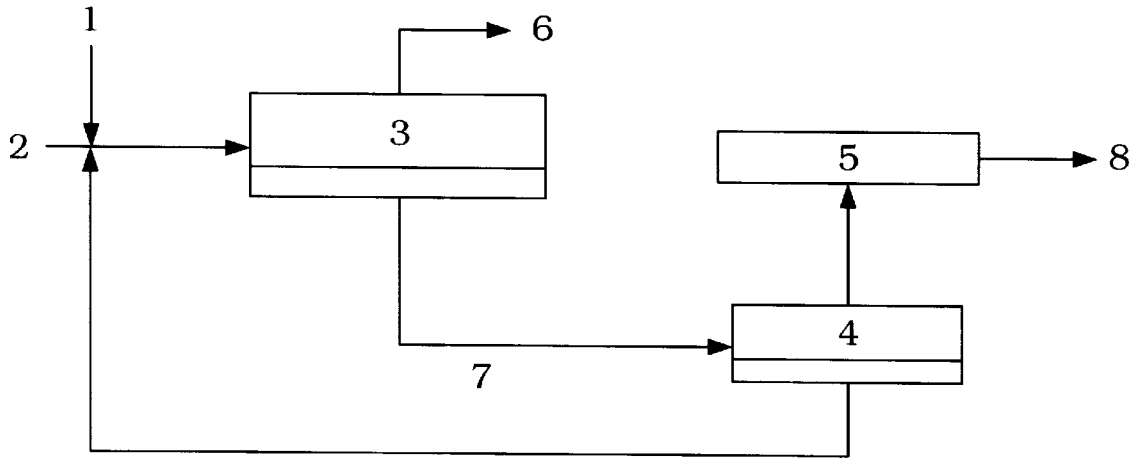
FIG. 2 is a flow diagram depicting how the process can be applied to existing refineries. (1) is water and alkoxylated amine, (2) is starting crude oil, (3) is the desalter, (4) is the regeneration unit, (5) is the organic acid conversion unit, (6) is treated crude having organic acids removed, (7) is lower phase emulsion, and (8) is products.

FIG. 2 depicts the instant process when applied in a refinery. The process is applicable to both production and refining operations. The acidic oil stream is treated with the required amount of alkoxylated amine by adding the amine to the wash water and mixing with a static mixer at low shear. Alternatively, the alkoxylated amine can be added first, mixed and followed by water addition and mixing. The treated starting crude is then subjected to demulsification or separation in a desalting unit which applies an electrostatic field or other separation means. The oil with reduced TAN is drawn off at the top and subjected to further refining if desired. The lower aqueous and emulsion phases are drawn off together or separately, preferably together and discarded. They may also be processed separately to recover the treating amine. Likewise, the recovered aqueous amine solution may be reused and a cyclic process obtained. The naphthenic acid stream may be further treated, by methods known to those in the art, to produce a non-corrosive product, or discarded as well.

Figure 3:
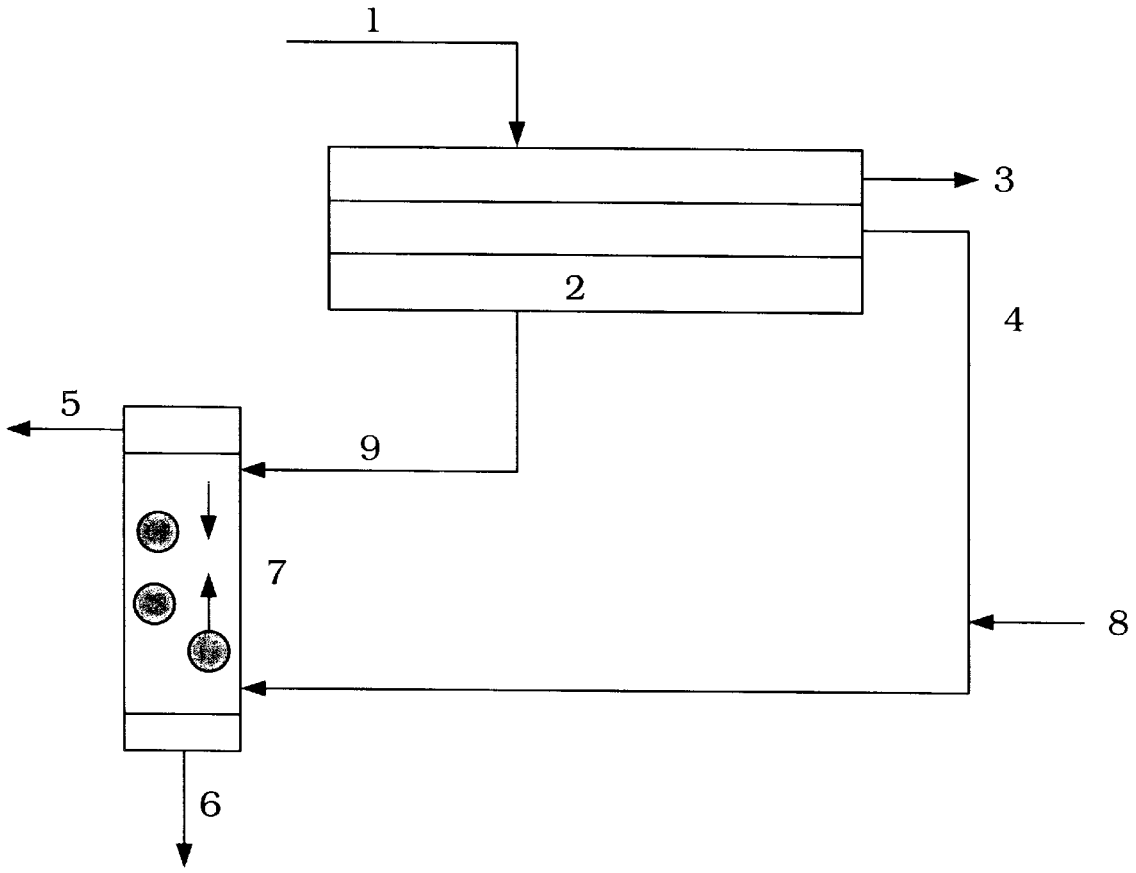
FIG. 3 is a flow scheme depicting the application of the instant invention at the well head. (1) is a full well stream, (2) is a primary separator, (3) is gas, (4) is crude, (5) is treated (upgraded) crude, (6) is water and organic acid, (7) is a contact tower, (8) is alkoxylated amine, and (9) is water.

In a production process, the instant invention would be especially applicable at the well head. At the well head, starting crudes typically contain co-produced water and gases. FIG. 3 illustrates the applicability of the instant invention at the well head. In FIG. 3, a full well stream containing starting crude, water and gases is passed into a separator, and separated into a gas stream which is removed, a water stream which may contain trace amounts of starting crude, and a starting crude stream (having water and gases removed) which may contain trace amounts of water. The water and crude streams are then passed into a contact tower. Alkoxylated amine can be added to either the crude or water and the instant treatment and mixing carried out in the contact tower. The water and crude streams are passed in a countercurrent fashion in the contact tower, in the presence of alkoxylated amine, to form an unstable oil-in-water emulsion. An unstable emulsion is formed by adding the acidic crude oil with only mild agitation to the aqueous phase in a sufficient ratio to produce a dispersion of oil in a continuous aqueous phase. The crude oil should be added to the aqueous phase rather than the aqueous phase being added to the crude oil, in order to minimize formation of a stable water-in-oil emulsion. A ratio of 1:3 to 1:15, preferably 1:3 to 1:4 of oil to aqueous phase is used based upon the weight of oil and aqueous phase. A stable emulsion will form if the ratio of oil to aqueous phase is 1:1 or less. The amount of alkoxylated amine will range from about 0.15 to about 3 molar equivalents based upon the amount of organic acid present in the starting crude. Aqueous phase is either the water stream, if alkoxylated amine is added directly to the crude or alkoxylated amine and water if alkoxylated amine is added to the water stream. Droplet size from 10 to 50 microns, preferably 20–50 microns, is typically needed. Contacting of the crude oil and aqueous alkoxylated amine should be carried out for a period of time sufficient to disperse the oil in the aqueous alkoxylated amine preferably to cause at least 50% by weight, more preferably, at least 80% and, most preferably, 90% of the oil to disperse in the aqueous alkoxylated amine. The contacting is typically carried out at temperatures ranging from about 10° C. to about 40° C. At temperatures greater than 40° C., the probability of forming a stable emulsion increases. The naphthenic acid ammonium salts produced are stripped off the crude droplets as they rise from the bottom of the contact tower. The treated crude is removed from the top of the contact tower and water containing alkoxylated amine salts of naphthenic acids (lower layers) is removed from the bottom of the contact tower. In this way, an upgraded crude having naphthenic acids removed therefrom is recovered at the well head. The treated crude may then be treated, such as electrostatically, to remove any remaining water and naphthenic acids if desired.

The water and organic acid alkoxylated amine salt byproducts removed from the contact tower can be reinjected into the ground. However, due to the cost of the alkoxylated amine, it will be desirable to perform a recovery step prior to reinjection.

The recovered alkoxylated amine can then be reused in the process, thereby creating a cyclic process.

If it is desirable to regenerate the organic acids, including naphthenic acids and alkoxylated amines, the following process can be used. The method comprises the steps of (a) treating the layers remaining following removal of said treated crude layer including said emulsion layer, with an acidic solution selected from the group comprising mineral acids or carbon dioxide, at a pressure and pH sufficient to produce naphthenic acids and an amine salt of said mineral acid when mineral acid is used or amine bicarbonate when carbon dioxide is used, (b) separating an upper layer containing naphthenic acids and a lower aqueous layer; (c) adding, to the lower aqueous layer, an inorganic base if step (a) utilizes a mineral acid, or heating at a temperature and for a time sufficient, if step (a) utilizes carbon dioxide to raise the pH to $\geqq 8$; (d) blowing gas through said aqueous layer to create a foam containing said alkoxylated amines; (e) skimming said foam to obtain said alkoxylated amines. The foam may further be collapsed or will collapse with time. Any gas which is inert or unreactive in the instant process can be used to create the foam; however, preferably, air will be used. Suitable gases are readily selectable by the skilled artisan. If it is desirable to collapse the foam, chemicals known to the skilled artisan can be used, or other known mechanical techniques.

In the method used to recover the alkoxylated amines, a mineral acid may be used to convert any alkoxylated amine salts of naphthenic acid formed during naphthenic acid removal from a starting crude. The acids may be selected from sulfuric acid, hydrochloric acid, phosphoric acid and mixtures thereof. Additionally, carbon dioxide may be added to the emulsion of amine alkoxylated salts under pressure. In either scenario, the acid addition is continued until a pH of about 6 or less is reached, preferably, about 4 to 6. Acid addition results in formation of an upper naphthenic acid containing oil layer, and a lower aqueous layer. The layers are then separated and to the aqueous layer is added an inorganic base such as ammonium hydroxide, sodium hydroxide, potassium hydroxide or mixtures thereof, if a mineral acid was used, to obtain a pH of greater than about 8. Alternatively, the aqueous layer is heated at a temperature and for a time sufficient, if carbon dioxide is used to obtain a pH of greater than about 8. Typically, the layer will be heated to about 40 to about 85° C., preferably, about 80° C. A gas, for example, air, nitrogen, methane or ethane, is then blown through the solution at a rate sufficient to create a foam containing the alkoxylated amines. The foam is then recovered and collapsed to obtain the alkoxylated amine. The recovery process can be used either in the refinery or at the well head prior to reinjection.

The invention will now be illustrated by the following examples which are not meant to be limiting.

EXAMPLE 1

In this example a 40/30/30 "ISOPAR-M"/Solvent 600 Neutral/Aromatic 150 was used as a model oil. "ISOPAR M" is an isoparaffinic distillate, Solvent 600 Neutral is a base oil, and Aromatic 150 is an aromatic distillate. 5-β cholanic acid was used as the model naphthenic acid.

2 wt % of the acid was solubilized in the model oil and subjected to the process steps noted herein using a dodecyl pentaethoxylate amine (R=$C_{12}$ and m+n=5). Mixing time was 15 minutes at room temperature. The total acid number of the model oil dropped from 4.0 to 0.2. High Performance Liquid Chromatography revealed a 99% removal of the 5-β cholanic acid from the treated oil.

EXAMPLE 2

A North Sea Crude (Gryphon) having a TAN of 4.6 was utilized in this example. The alkoxylated amine shown was used at the noted wt % water addition and amine treat rate. The results are tabulated in Table 1.

TABLE 1

| Amine | Amine Treat Rate (mole equivalents) | Water Wt % | TAN after treat |
|---|---|---|---|
| $C_{12}H_{25}N(EO)_mH(EO)_nH$ m + n = 5 | 2.5 | 10 | 1.2 |
| NONE | 0 | 10 | 4.2 |

EXAMPLE 3

An alkoxylated ammonium salt of naphthenic acid was prepared by neutralizing a sample of commercial naphthenic acid with an equimolar amount of dodecyl pentaethanol amine. A 30 wt % solution of the salt was made in water to create a model emulsion containing alkoxylated ammonium naphthenate salt.

100 mL of the organic salt solution was taken in a separatory funnel and concentrated sulfuric acid added to bring the pH to 6. An instant release of naphthenic acid as a water insoluble oil was observed. The lower aqueous phase was separated from the oil phase and ammonium hydroxide added to obtain a pH of 9.

Figure 4:
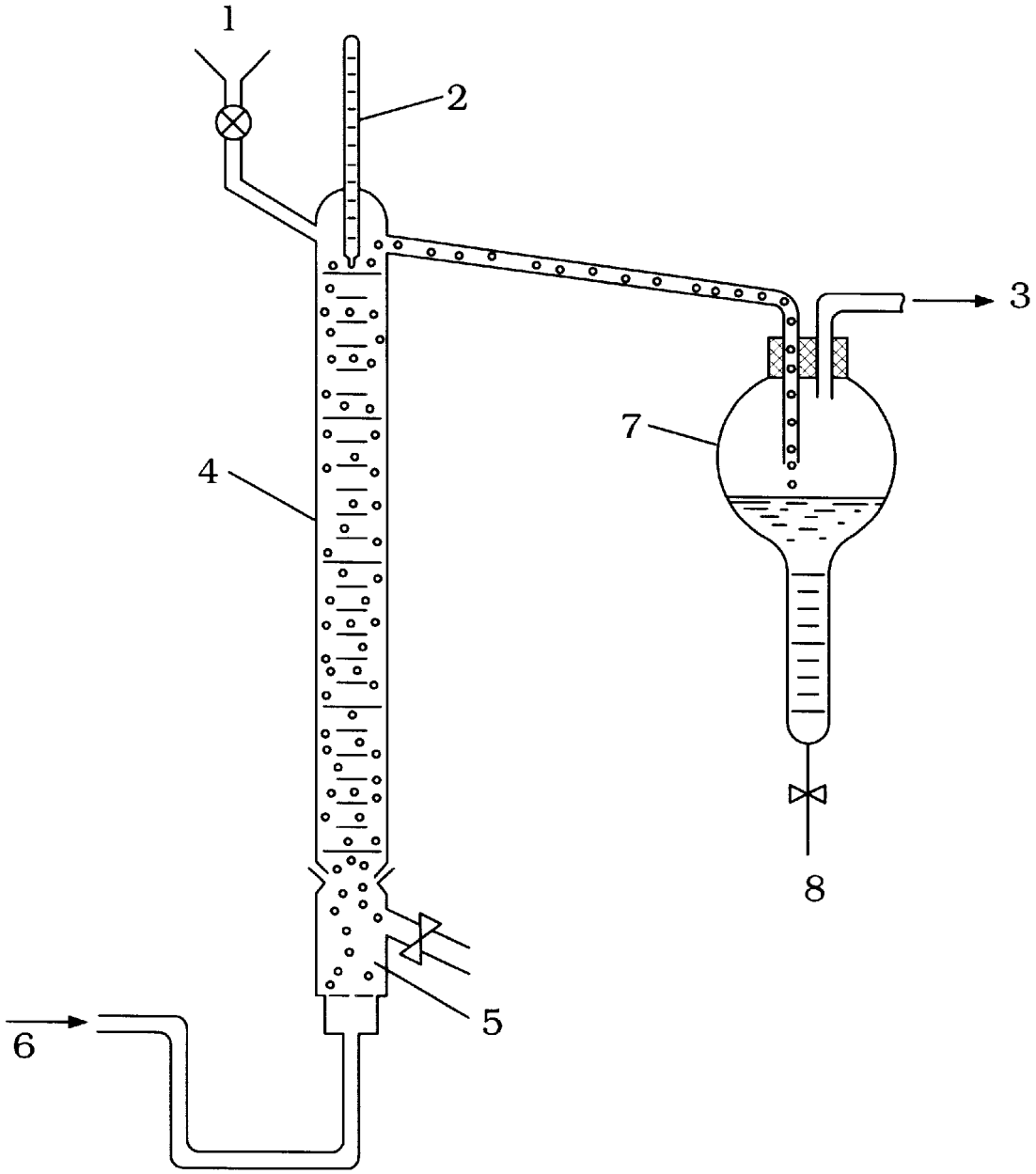
FIG. 4 is an apparatus usable in recovering alkoxylated amines that have been used to remove naphthenic acids from a starting crude. (1) is a layer or phase containing alkoxylated amine, (2) is a thermometer, (3) is a vent, (4) is a graduated column for measuring foam height, (5) is a gas distributor, (6) is gas, (7) is where the foam breaks, and (8) where the recovered alkoxylated amine is collected.

The aqueous solution was introduced into a foam generation apparatus as shown in FIG. 4. Air was bubbled through the inlet tube at the bottom. A copious foam was generated and collected in the collection chamber. The foam collapsed upon standing resulting in a yellow liquid characterized as a concentrate of dodecyl pentaethanol amine.

EXAMPLE 4

A North Sea crude, Gryphon was subjected to the emulsion fractionation process described in Example 2. The lower emulsion phase was extracted and used as follows:

100 mL of the emulsion was taken in a separatory funnel and concentrated sulfuric acid added to bring it to a pH of 6. An instant release of naphthenic acid as a water insoluble oil was observed. The lower aqueous phase was separated from the oil phase. The oil phase was analyzed by FTIR and $^{13}C$ NMR to confirm the presence of naphthenic acids. HPLC analysis indicated 250 to 750 molecular weight naphthenic acids were extracted. Ammonium hydroxide was added to the aqueous phase to obtain a pH of 9. The aqueous solution was introduced into the foam generation apparatus shown in FIG. 4. Air was bubbled through the inlet tube at the bottom to generate a stable sustained foam that was collected in the collection chamber. The foam collapsed upon standing resulting in a yellow liquid characterized as a concentrate of docecyl pentaethanol amine.

EXAMPLE 5

A North Sea Crude, Gryphon was subjected to the emulsion fractionation process described in Example 2. The lower emulsion phase was extracted and used as follows:

100 mL of the emulsion was taken into an autoclave, solid $CO_2$ added and the emulsion was stirred at 300 rpm at 80° C. and 100 psi for 2 hours. The product was centrifuged for 20 minutes at 1800 rpm to separate the water insoluble naphthenic acids from the aqueous phase. The oil phase was analyzed by FTIR and $^{13}C$ NMR to confirm the presence of naphthenic acid. HPLC analysis indicated 250 to 750 molecular weight naphthenic acids were extracted.

The lower aqueous phase was at a pH of 9 indicating regeneration of the organic amine. The aqueous solution was introduced into the foam generation apparatus shown in FIG. 4. Air was bubbled through the inlet tube at the bottom to generate a stable sustained foam that was collected in the collection chamber. The foam collapsed upon standing resulting in a yellow liquid characterized as a concentrate of docecyl pentaethanol amine.

EXAMPLE 6

In this example a 40/30/30 "ISOPAR M"/Solvent 600 Neutral/Aromatic 150 was used as a model oil, 5-β cholanic acid was used as the model naphthenic acid, and N,N'-bis (2-hydroxyethyl) ethylene diamine (y=z=1, x=1). The acidic oil was treated with an equimolar amount (based upon the amount of 5-β cholanic acid) of N,N'-bis(2-hydroxyethyl) ethylene diamine, 5 wt % water was added to the treated oil and mixed. Centrifugation was used to separate the naphthenic acid as its salt into a lower emulsion phase.

The Total Acid Number (TAN) of the acidic model oil was reduced from 2.9 to less than 0.2.

EXAMPLE 7

A North Sea crude, Gryphon (TAN=4.6) was used in this example. The amine was used at the following conditions:

The mole ratio of N,N'-bis(2-hydroxyethyl) ethylene diamine to acid=2.5.

Reaction temperature=25° C.

Reaction time=5 minutes

Volume of wash water=10 wt %

Mixing of wash water=gentle tumbling of oil-water mixture for 10 minutes

Separation=centrifugation at 1800 rpm for 30 minutes.

TAN reduction from 4.6 to 1.5 with about 96% yield of the treated oil was achieved.

HPLC of the untreated and emulsion fractionated oil revealed that naphthenic acids in molecular weights from 250 to 750 were extracted.

What is claimed is:

1. A process for extracting organic acids from a starting crude oil comprising the steps of:

(a) treating the starting crude oil containing naphthenic acids with an amount of an alkoxylated amine and water under conditions and for a time and at a temperature sufficient to form a water-in-oil emulsion of amine salt wherein the amount of water is about 5 to 10 wt % based upon the amount of starting crude, and wherein said alkoxylated amine is selected from the group consisting of alkoxylated amines having the following formulae A and B:

(A)

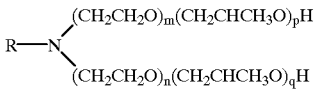

where m+n=5 to 50 and R=linear or branched alkyl group of $C_8$ to $C_{20}$.

(B) $H\text{-}(OCH_2CH_2)_y\text{-}(CH_2CHCH_3O)_p\text{-}\{NHCH_2CH_2NH\}_x\text{-}(CH_2CH_2O)_z\text{-}(CH_2CHCH_3O)_q\text{-}H$ where x=1 to 3 and y+z=2 to 6, and wherein p+q=0 to 15, mixtures of formula (A) and mixtures of formula (B); and (b) separating said emulsion of step (a) into a plurality of layers or phases, wherein one of such layers or phases contains a treated crude oil having decreased amounts of organic acids;

(c) recovering said layer of step (b) containing said treated crude oil having a decreased amount of organic acid and layers containing water and alkoxylated amine salt.

2. The process of claim 1 wherein said water is added simultaneously with or following said alkoxylated amine.

3. The process of claim 1 wherein said naphthenic acids range in molecular weight from about 150 to about 800.

4. The process of claim 1 wherein said amount of alkoxylated amine is about 0.15 to about 3 molar equivalents per molar equivalent of organic acid present in the crude.

5. The process of claim 1 wherein said steps (a) and (b) are conducted at temperatures of about 20 to about 220° C.

6. The process of claim 1 wherein said steps (a) and (b) are conducted for times of about one minute to about one hour.

7. The process of claim 5 wherein when said starting crude has an API index of above 20 or lower, said temperature is about 60° C.

8. The process of claim 1 wherein said separation step (c) is achieved using gravity settling, electrostatic field separation, centrifugation or a combination thereof.

9. The process of claim 1 wherein co-solvents can be added with said water.

10. The process of claim 1 wherein demulsifiers are added to said separation step.

11. The process of claim 1 wherein said process is conducted in a refinery and said separation is conducted in a desalting unit to produce a phase containing a treated crude having organic acids removed therefrom, and phase containing water and alkoxylated amine salts.

12. A method according to claims 1 or 11 for recovering said alkoxylated amine further comprising (a) contacting the layer or phase containing alkoxylated amine salt of organic acids with an acid selected from the group comprising mineral acids or carbon dioxide in an amount sufficient and under conditions to produce organic acids and an aqueous layer; (b) separating an upper layer containing organic acids and a lower aqueous layer; (c) adding, to the lower aqueous layer, an inorganic base if step (a) utilizes a mineral acid, or heating at a temperature and for a time sufficient if step (a) utilizes carbon dioxide, to raise the pH of the layer to greater than or equal to 8; (d) blowing a gas through said aqueous layer to produce a foam containing said alkoxylated amine; (e) recovering said foam containing said alkoxylated amine.

13. The method of claim 12 wherein said mineral acid is selected from the group consisting of sulfuric acid, hydrochloric acid, phosphoric acid and mixtures thereof.

14. A method according to claim 12 wherein when said regeneration is conducted in a refinery said recovered alkoxylated amine is recycled in the process.

15. A process according to claim 1 wherein said alkoxylated amine is dodecyl pentaethoxy amine.

16. The process according to claim 1 wherein said amine of formula (B) is N,N'-bis(2-hydroxyethyl) ethylene diamine.

17. The process of claim 1 wherein said organic acid is a naphthenic acid.

18. The method of claim 1 wherein said amine is a mixture of amines of formula (A) and formula (B).

19. A process according to claim 1 wherein said alkoxylated amine is dodecyl pentaethoxy amine.

20. The process according to claim 1 wherein said amine of formula (B) is N,N'-bis(2-hydroxyethyl) ethylene diamine.

21. The process of claim 1 wherein said organic acid is a naphthenic acid.

22. The method of claim 1 wherein said amine is a mixture of amines of formula (A) and formula (B).

23. A process for extracting organic acids from a starting crude comprising the steps of:

(a) countercurrently contacting said starting crude with an amount of water in a ratio of said water to said starting crude of 1:3 to 1:15, in the presence of an amount of alkoxylated amine for a time and at a temperature sufficient to form an oil in water emulsion of an amine salt wherein said amine is from the group consisting of alkoxylated amines having the following formulae A and B:

(A)

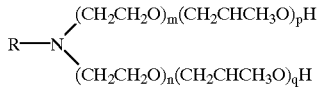

where m+n=5 to 50 and R=linear or branched alkyl group of $C_8$ to $C_{20}$.

(B) $H\text{-}(OCH_2CH_2)_y\text{-}(CH_2CHCH_3O)_p\text{-}\{NHCH_2CH_2NH\}_x\text{-}(CH_2CH_2O)_z\text{-}(CH_2CHCH_3O)_q\text{-}H$ where x=1 to 3 and y+z=2 to 6, and wherein p+q=0 to 15, mixtures of formula (A) and mixtures of formula (B); and (b) separating said emulsion of step (a) into a plurality of layers or phases, wherein one of such layers or phases contains a treated crude oil having decreased amounts of organic acids;

(c) recovering said layer of step (b) containing said treated crude oil having a decreased amount of organic acid and layers containing water and alkoxylated amine salt.

24. The process of claim 23 wherein said process is conducted at a well head and said starting crude is contained in a full well stream from said well head and comprising passing said full well stream into a separator to form a gas stream, a starting crude stream containing organic acids and a water stream; countercurrently contacting said starting crude stream with an amount of said water stream in the presence of an amount of an alkoxylated amine for a time and at a temperature sufficient to form said oil in water emulsion of an amine salt.

25. The process of claim 23 wherein said water is added simultaneously with or following said alkoxylated amine.

26. The process of claim 23 wherein said naphthenic acids range in molecular weight from about 150 to about 800.

27. The process of claim 23 wherein said amount of alkoxylated amine is about 0.15 to about 3 molar equivalents per molar equivalent of organic acid present in the crude.

28. The process of claim 23 wherein said steps (a) and (b) are conducted at temperatures of about 10 to about 40° C.

29. The process of claim 23 wherein said steps (a) and (b) are conducted for times of about one minute to about one hour.

30. The process of claim 23 wherein said separation step (c) is achieved using gravity settling, electrostatic field separation, centrifugation or a combination thereof.

31. The process of claim 23 wherein co-solvents can be added with said water.

32. The process of claim 23 wherein demulsifiers are added to said separation step.

33. A method according to claim 23 for recovering said alkoxylated amine further comprising (d) contacting the layer or phase containing alkoxylated amine salt of organic acids with an acid selected from the group comprising mineral acids or carbon dioxide in an amount sufficient and under conditions to produce organic acids and an aqueous layer; (e) separating an upper layer containing organic acids and a lower aqueous layer; (f) adding, to the lower aqueous layer, an inorganic base if step (d) utilizes a mineral acid, or heating at a temperature and for a time sufficient if step (d) utilizes carbon dioxide, to raise the pH of the layer to greater than or equal to 8; (g) blowing a gas through said aqueous layer to produce a foam containing said alkoxylated amine; (h) recovering said foam containing said alkoxylated amine.

34. The method of claim 33 wherein said mineral acid is selected from the group consisting of sulfuric acid, hydrochloric acid, phosphoric acid and mixtures thereof.

35. A method according to claim 33 wherein when said regeneration is applied in a refinery, said recovered alkoxylated amine is recycled in the process.

* * * * *